United States Patent [19]

Heberer

[11] Patent Number: 4,973,045

[45] Date of Patent: Nov. 27, 1990

[54] APPARATUS FOR THE PRACTICE OF MARTIAL ARTS

[76] Inventor: Bill Heberer, P.O. Box 553, Indiana, Pa. 15701

[21] Appl. No.: 341,979

[22] Filed: Apr. 24, 1989

Related U.S. Application Data

[63] Continuation-in-part of Ser. No. 194,504, May 16, 1988, abandoned.

[51] Int. Cl.[5] ..... A63B 26/00

[52] U.S. Cl. ..... 272/76

[58] Field of Search ..... 272/76, 77, 78, 123

[56] References Cited

U.S. PATENT DOCUMENTS

| | | | |
|---|---|---|---|
| 1,270,034 | 6/1918 | Krudop | 272/123 |
| 4,491,316 | 1/1985 | Prince | 272/76 |
| 4,533,138 | 8/1985 | Rodriquez, Jr. et al. . | |
| 4,572,504 | 2/1986 | DiBartolo | 272/76 |
| 4,749,184 | 6/1988 | Tobin | 272/76 |
| 4,757,989 | 7/1988 | Bauer | 272/76 |

*Primary Examiner*—Stephen R. Crow

*Attorney, Agent, or Firm*—Buchanan Ingersoll; Lynn J. Alstadt

[57] ABSTRACT

An apparatus is provided for positioning and securing at least one target board at a particular height and angle for the practice of martial arts. A frame having at least one rail is utilized to adjustably mount a target support, which is retained in position on the rail by a clamp. The target support preferably has two sides, each extending from a rail. The sides are sized and positioned to receive and restrain at least one target board. The sides have a spring property which allows them to be forced apart and a target board to be inserted therebetween. The sides thus tend to spring back toward the original position to hold the target board. Clips are mounted on the sides and are located at the distal ends of the wing members. The clips are adapted to position and support the target board with relation to the sides.

9 Claims, 2 Drawing Sheets

APPARATUS FOR THE PRACTICE OF MARTIAL ARTS

CROSS REFERENCE TO RELATED APPLICATION

This is a continuation, in part, of my U.S. patent application, Ser. No. 194,504, filed May 16, 1988, now abandoned.

BACKGROUND OF THE INVENTION

1. Field of the Invention

The present invention relates to an apparatus for the practice of martial arts. More specifically, the invention relates to a device which will position and support one or more wooden boards to be broken by a practitioner utilizing martial arts.

2. Description of the Prior Art

A number of devices have been designed for the replacement of a human holder in the practice of breaking target boards by martial arts. The prior art is principally illustrated by Prince, U.S. Pat. No. 4,491,316 and Bauer, Jr., U.S. Pat. No. 4,757,989.

The principal shortcomings of the prior art center on three areas: providing a clear target to the practitioner without obstructions, ease of adjustment and movement, and extension of the target away from the supporting structure to allow greater latitude of movement for the practitioner.

Both Bauer, Jr. and Prince obscure a portion of the target in supporting it. Prince utilizes straps across the face of the target to hold the target against support members. Bauer, Jr. utilizes slots cut in the supports above and below the target. Bauer, Jr. also extends the target supports beyond the plane of the face of the target. This obstruction of the target and protrusion of the support beyond the target are both dangerous and unpredictable for the practitioner. If he should strike the support or straps rather than the target face, severe injury could result, as well as a diminishment of score in competition. This is particularly true of novice users, who would be more likely to strike the supports, and would be less prepared for such an occurrence.

The prior art devices are also not readily adjustable and portable. The Prince apparatus is generally adjustable in the vertical, but not readily angularly adjustable, having only a series of stepped angular positions. Additionally, the device is not portable or readily movable, being constructed of metal and utilizing a metal tank for weight and stability. The tank is intended to be filled with water or sand.

The Bauer, Jr. device is more angularly adjustable, having an infinite number of positions, but is not height adjustable beyond a limited range. Similarly, height adjustment in the lower direction decreases the amount of body space for the practitioner under the target. Even at its maximum height, the lower base of the device extends into the practitioner's body area.

Thus, there is a need in the art for a target holder which is easily moveable, positions the target away from the supporting structure, and presents a clear, unobscured target.

SUMMARY OF THE INVENTION

I provide an apparatus for positioning and securing at least one target board at a selected height and angle. The apparatus replaces a human holder in the practice of breaking wooden boards in martial arts competition.

Unlike the prior art, the apparatus has no protruding support structure beyond the face of the target and leaves the entire face of the target visible and unobscured. Additionally, the target is located a significant distance from the support structure. The target board which is utilized with my apparatus may be either a padded practice board, or the standard sized wood target. The apparatus is intended to hold at least one of such wooden target boards, and may hold more. Two present preferred embodiments of the apparatus are described herein.

A first preferred embodiment of the device is constructed of a base having a rail means attached thereto. The frame of the device is lightweight and foldable, allowing for ease of movement. The base has a plurality of legs, at least one of which is utilized as the rail in the preferred embodiments. Additionally, the base preferably has a platform mounted thereon, sized and adapted for the placement of weights, to support the device during operation. Any ordinary heavy object, such as a cinder block may be utilized for this purpose.

The target is held in a target support means which is slidably mounted on the rail means, and is preferably retained in position on the rail by a clamp. The target support means has a base, with a plurality of pivotably adjustable, spaced apart wing members mounted thereon. These wing members are sized and adapted to receive and restrain at least one standard sized target board. The resilient members are displaced by the insertion of the target board and such displacement serves to restrain the target board by a spring action.

The target support is preferably comprised of three elements: a target support base, arms and wing members. The target support base is mounted onto the rail means. The arms are mounted upon the target support base and extend outwardly therefrom. The wing members are then pivotably mounted on the ends of the arms and extend outwardly therefrom. The wing members are sized and adapted to receive and restrain at least one standard sized target board. The arms and wings are displaced by the insertion of the target board and such displacement thus serves to restrain the target board.

Locational means are mounted on the members, and in the preferred embodiment are located at the distal ends of the wing members. These locational means are preferably clips which are adapted to position and support the target board with relation to the wing members.

In this first preferred embodiment, the target board is mounted perpendicularly to the members.

I provide a second embodiment which utilizes a base and at least one rail means, but has a target support means slidably mounted on the rail means. Here, a single pivotably adjustable member is sized and adapted to receive and restrain a standard sized target board. As in the first embodiment, the target may be padded, for practice, or an actual wooden target. Clamping means are mounted on the member and adapted to position and restrain the target board on the members. The target is clamped to the arm and extends coplanar to the arm outwardly from the rail.

In this second embodiment the target support means preferably is comprised of a single arm mounted upon the rail means and extending outwardly therefrom, and a single wing member pivotably mounted at the other end of the arm. The wing member is sized and adapted to receive and restrain at least one standard sized target board. The target is secured to the wing member by clamps, located on the wing members, for locating and supporting at least one such target board.

Alternatively, a second individual arm may be mounted on a second rail, and the target mounted perpendicularly therebetween. The spring quality of the arms will support the target in a similar manner as the first embodiment.

These and other advantages and features of the present invention will be more fully understood on reference to the presently preferred embodiments thereof shown in the appended drawings.

DESCRIPTION OF THE PREFERRED EMBODIMENTS

Figure 1:
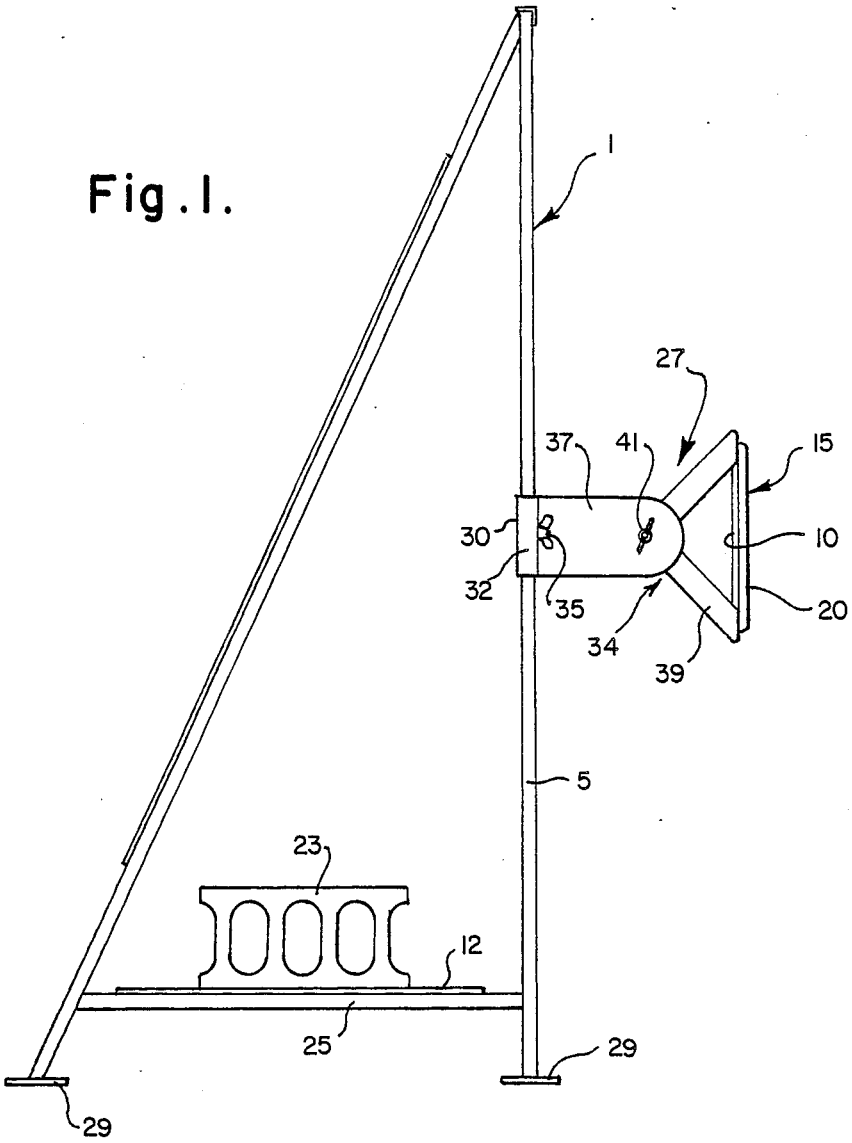
FIG. 1 is a side elevational view of a first preferred embodiment of my apparatus.

Referring to FIG. 1, a frame 1 is provided which is preferably in the form of a four legged easel. A platform 12 is mounted on a cross member 25, and is intended to support a weight, which is depicted as a cinder block 23. The weight is utilized to provide support and balance for the apparatus while it is in use. The front legs 5 of the base are utilized as rails upon which the target support 27 is moved. Feet 29 are provided for balance and stability.

Figure 2:
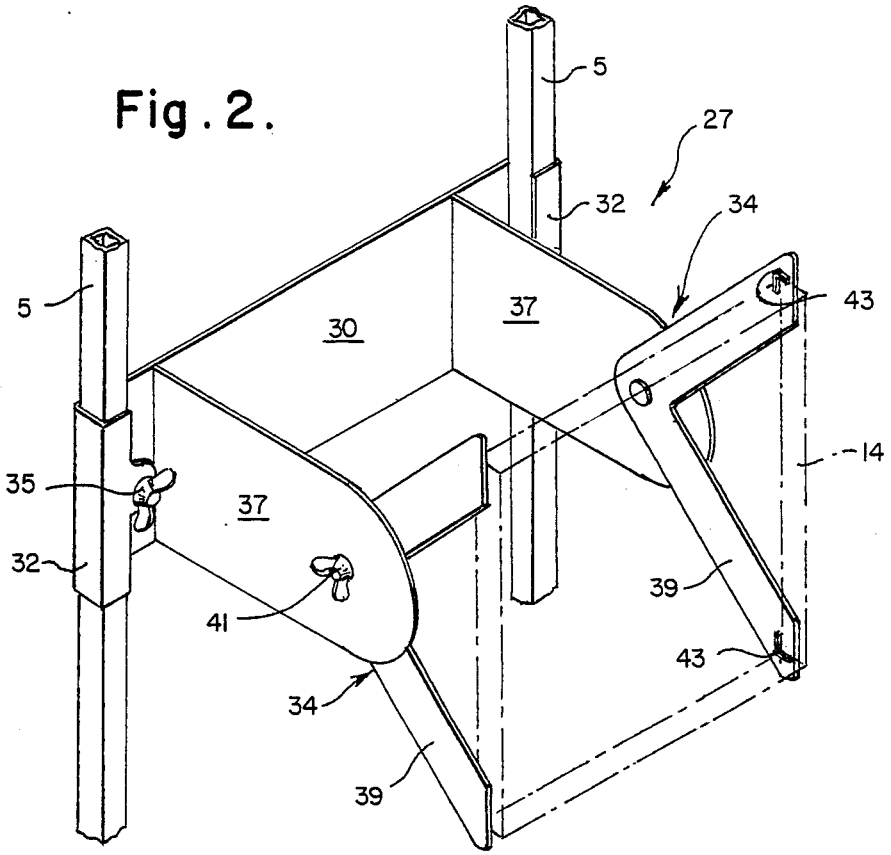
FIG. 2 is an isometric view of the target support for the first preferred embodiment of the apparatus shown in FIG. 1.

A target support 27 is comprised of a target support base 30 having support clamps 32 at each end (FIG. 2). Each clamp 32 encircles one leg 5, allowing vertical adjustment thereon. The target support 27 is secured in place by tightening wingnuts 35 to compress support clamps 32 around legs 5. Set screws or other securement means could also be used. Two sides 34 extend from base 30

Arms 37 extend outwardly from the support base 30. Wings 39 are pivotably mounted on the ends of the arms 37 and are angularly adjustable to position the target properly. Wingnuts 41 hold the wings 39 in position. Locating means 43, such as L-shaped clips, are mounted on the wings 39 and are utilized to locate wooden target 14, shown in chain line in FIG. 2, or a padded practice target 15, as shown in FIG. 1, between the wings 39. Arms 37 or wings 39 are preferably made from sheet metal which allows them to be pushed apart and spring back to their original position. The original distance between arms 39 should be somewhat less than the target size. To insert the target, wings 39 are forced apart then the target is inserted between them. When the wings 39 are released, the spring properties of the arms 37, the wings 39 or both force the displaced wings 39 together holding the target in place. Arm 37 and wing 39 together form a resilient side. Locating means 43 assure proper target orientation. It should be specifically noted that target 14 extends beyond the edges of wings 39. In this manner, the face of target 14 is completely exposed and no support structure obscures the face in any way. This is designed to prevent injury to the practitioner who might accidentally strike such a support structure during use, injuring him or herself. One may also use a padded practice target 15 shown in FIG. 1. This unit 15 is comprised of a base board 10 and a pad 20 mounted thereon. Multiple wooden targets 14, not shown, may also be utilized, in place of target 14. They may be taped together and the group mounted as a unit between wings 39.

Figure 4:
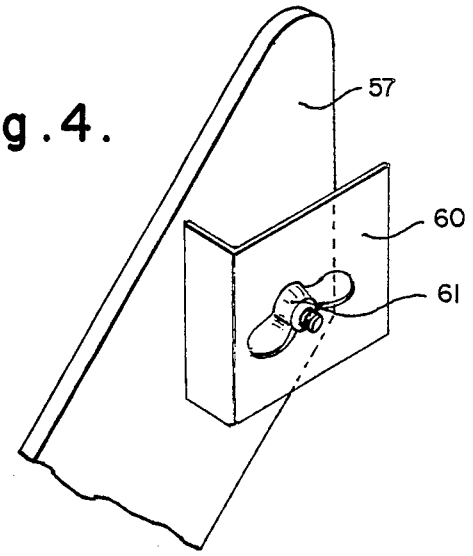
FIG. 4 is an isometric view of the target clamp according to the embodiment of the FIG. 3.
Figure 3:
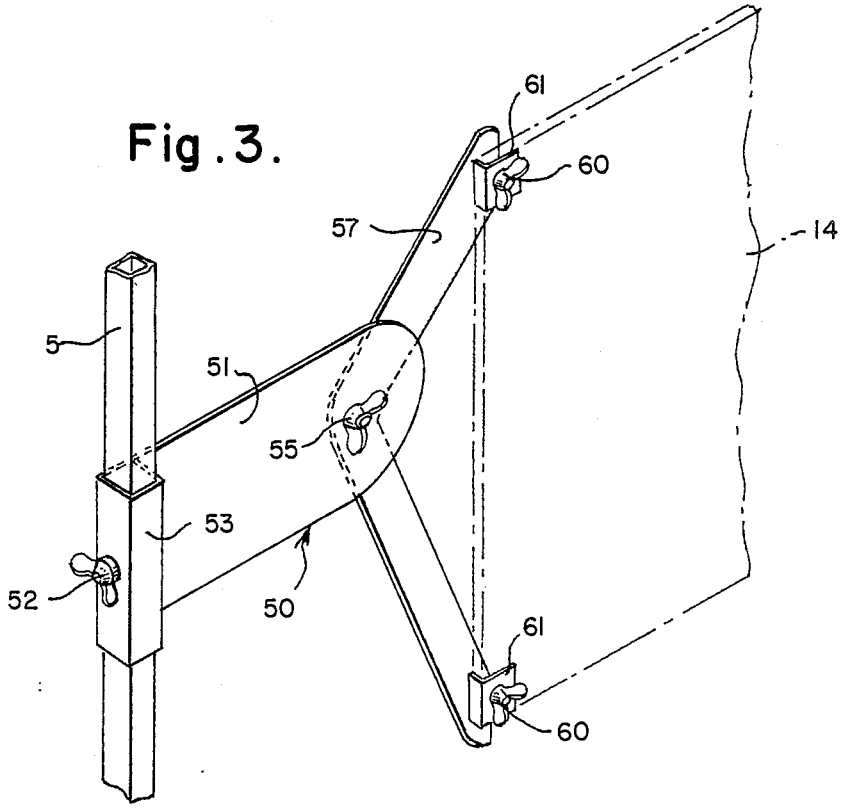
FIG. 3 is an isometric view of the target support according to a second preferred embodiment of my apparatus.

Referring to FIGS. 3 and 4, a second embodiment is shown. A single side 50 is comprised of arm 51, and clamp end 53 which is slidably mounted on leg 5 which serves as a rail. This side 50 preferably is made of sheet metal which provides spring characteristics similar to sides 3 of the first preferred embodiment. The resilient member 50 is vertically adjustable and restrained by wingnut 52 which tightens clamp end 53.

A resilient wing member 57 is pivotably mounted at the end of resilient arm 51 and is angularly adjustable. Wingnut 55 holds the resilient wing member 57 in position. The side 50 and attached wing 57 together form a resilient side. Clamps 61 are located at the distal ends of the resilient wings 57 and hold the target in place by pressure from wingnuts 60. The target is mounted coplanar with side 50.

It should be noted that the wing member 39 may be alternatively mounted on resilient arm 51 of the second embodiment. Combined with a similar arm and wing arrangement on the second rail, a target 14 may thus be supported in a perpendicular fashion therebetween. This allows the use of two individual arms 51 rather than base 30 and arms 37 for such support.

While I have described certain present preferred embodiments of my invention, it is to be distinctly understood that the invention is not limited thereto but may be otherwise embodied and practiced within the scope of the following claims.

I claim:

1. An apparatus for positioning and securing at least one target board at a particular height and angle in a manner to expose at least one face of the target which may be struck by a martial arts practitioner, comprising:

(a) a frame having a pair of generally parallel support rails;

(b) target support means slidably mounted on said rails comprising:

(i) a base interposed between said rails and having two resilient sides which are intermediate to said rails, the resilient sides sized and positioned to receive and restrain at least one target board, the resilient sides having a spring property which allows the sides to be forced apart and a target board to be inserted therebetween, the resilient sides tending to move back toward an original position to hold the target board said base including peripheral clamping means engaging said rails for positioning of the target support means;

(ii) locational means, mounted on the resilient sides adapted to position the target board with relation to the resilient sides.

2. The apparatus of claim 1 wherein the resilient sides and locational means are sized and positioned so as not to obstruct the exposed face of the target.

3. An apparatus as described in claim 1, also comprising a weight placed on the frame.

4. An apparatus as described in claim 3, wherein the weight is a cinder block.

5. An apparatus as described in claim 1, wherein the frame has a platform mounted thereon, sized and adapted for the placement of at least one weight.

6. An apparatus as described in claim 1, wherein each resilient side is comprised of:

an arm mounted upon the base and extending outwardly therefrom; and a wing member pivotably mounted, at one end, on the arm and extending outwardly therefrom, and;

the locational means are clips, located on the resilient wing members, for locating and supporting at least one target board.

7. An apparatus as described in claim 1, wherein the target board is a padded practice board.

8. An apparatus as described in claim 1, wherein the target board is constructed of wood.

9. An apparatus as described in claim 1, wherein the target board is mounted perpendicularly to the resilient sides.

* * * * *

UNITED STATES PATENT AND TRADEMARK OFFICE

CERTIFICATE OF CORRECTION

PATENT NO. : 4,973,045

DATED : November 27, 1990

INVENTOR(S) : BILL HEBERER

It is certified that error appears in the above-identified patent and that said Letters Patent is hereby corrected as shown below:

Column 3, line 56, change "arms" to --wings--.

Column 4, line 13, change "3" to --34--.

Signed and Sealed this

Fifth Day of May, 1992

*Attest:*

DOUGLAS B. COMER

*Attesting Officer*

*Acting Commissioner of Patents and Trademarks*